United States Patent [19]

Stobb, deceased

[11] Patent Number: 4,555,101

[45] Date of Patent: Nov. 26, 1985

[54] METHOD AND APPARATUS FOR SEPARATING SIGNATURES FROM A STACK

[75] Inventor: Anton R. Stobb, deceased, late of Pittstown, N.J., by Walter J. Stobb, executor

[73] Assignee: Stobb, Inc., Clinton, N.J.

[21] Appl. No.: 588,934

[22] Filed: Mar. 13, 1984

[51] Int. Cl.[4] ..... B65H 39/02

[52] U.S. Cl. ..... 270/58; 271/12; 271/35; 271/95; 271/277; 271/204

[58] Field of Search ..... 270/54, 57, 58; 271/12, 271/35, 95, 204, 277; 198/423, 424, 550, 616, 644, 645, 654, 694

[56] References Cited

U.S. PATENT DOCUMENTS

| | | | |
|---|---|---|---|
| 3,275,315 | 9/1966 | Zugel | 270/54 |
| 3,552,740 | 1/1971 | Hepp | 271/95 |

FOREIGN PATENT DOCUMENTS

| | | | |
|---|---|---|---|
| 1277655 | 9/1968 | Fed. Rep. of Germany | 271/95 |
| 1536489 | 12/1969 | Fed. Rep. of Germany | 270/54 |
| 606337 | 7/1960 | Italy | 270/54 |
| 2102395 | 2/1983 | United Kingdom | 198/644 |

*Primary Examiner*—E. H. Eickholt

*Attorney, Agent, or Firm*—Arthur J. Hansmann

[57] ABSTRACT

Apparatus and process for collating folded signatures which are removed from a stack of signatures and placed in parallel side-by-side relationship on saddle members. The saddle members move in a direction transverse to the folds in the signature, and thus spacing of the saddle members is close together and the entire apparatus and process can be performed at a high speed, in that arrangement. A signature pickup device is employed for removing the signatures from the stack in a stream relationship and delivering them directly to a collector where a flap opener can be employed for positioning the signature flaps on opposite sides of the collector saddle members.

16 Claims, 3 Drawing Figures

METHOD AND APPARATUS FOR SEPARATING SIGNATURES FROM A STACK

This invention relates to a method and apparatus for collating signatures, and, more particularly, it relates to removing folded signatures from a stack and feeding them onto a saddle type of collector.

BACKGROUND OF THE INVENTION

The popular prior art manner of collating signatures in a saddle type of collector is to remove folded signatures from a stack and convey them to the saddle collector or raceway which receives the signatures while moving in the direction of the fold of the signatures. In that manner, the collector must move the distance of the complete length of the signature, measured along its line of fold, for each signature collected, and of course there must also be spaces between signatures on the collector. Therefore, the collector speed must be high for each signature collected thereon, since the entire length of the signature occupies a length of the collector in the direction of the eollector's movement, as mentioned. Examples of that type of prior art are seen in U.S. Pat. Nos. 2,903,260 and 3,089,693 and 3,416,786.

The present invention differs from the prior art and improves thereon by avoiding the necessity of requiring that the collector move the complete length of each folded signature in the collating process. Further, the present invention improves upon the prior art in that it moves the folded signature in a single path of movement directly from the stack of signatures and to the collector to ultimately place the signatures in a saddle type of accumulation on the collector. That is, no reversal or circuitous path of signature movement is required in the collating. Accordingly, the present invention is a high-speed type of collating method and apparatus, compared to the speed in the prior art, and thus greater production or more signatures are collated in either a given amount of time or in a given relative speed of the collector, compared to the prior art collector speed.

Still further, the present invention improves on the prior art by providing a system of vacuum take-off rollers which operate on the end of the stack of signatures to singly remove the signatures from the stack and to place them into the confines of a gripper. In this regard, the signatures are removed at relatively short intervals along the dimension of the signature so that the removed signatures form an imbricated or overlapped stream of signatures which are transported to the collector in stream relationship, rather than singly. The prior art U.S. Pat. Nos. 2,279,270 and 3,416,786 show the use of vacuum rollers for removing signatures or handling same, but they do not relate to removing signatures from a stack and into an imbricated stream relationship, as in the present invention. Accordingly, the present invention provides for the high-speed action desired and it also assures the accuracy of the procedure as well as the security of handling the signatures to avoid damage or misalignment. In the imbricated arrangement mentioned, the prior art collector is required to move a considerably greater distance than that required by the present invention, such as, the prior art collector commonly moves 25 inches per signature while the collector of this invention moves only $1\frac{1}{2}$ inches per signature collected.

Also, in accomplishing these aforesaid objectives, the present invention does not require any cam mechanisms or the like and there are only a few required moving parts for the apparatus, and those parts are readily synchronized, as required.

DETAILED DESCRIPTION OF THE PREFERRED METHOD AND APPARATUS

The drawings, and the description of the apparatus, will also disclose the method invention. A stack of sheets S is suitably supported in a hopper 10 such that the stack is in a reclining position with the folded signatures in the stack being in a substantially horizontal orientation, as shown.

Figure 1:
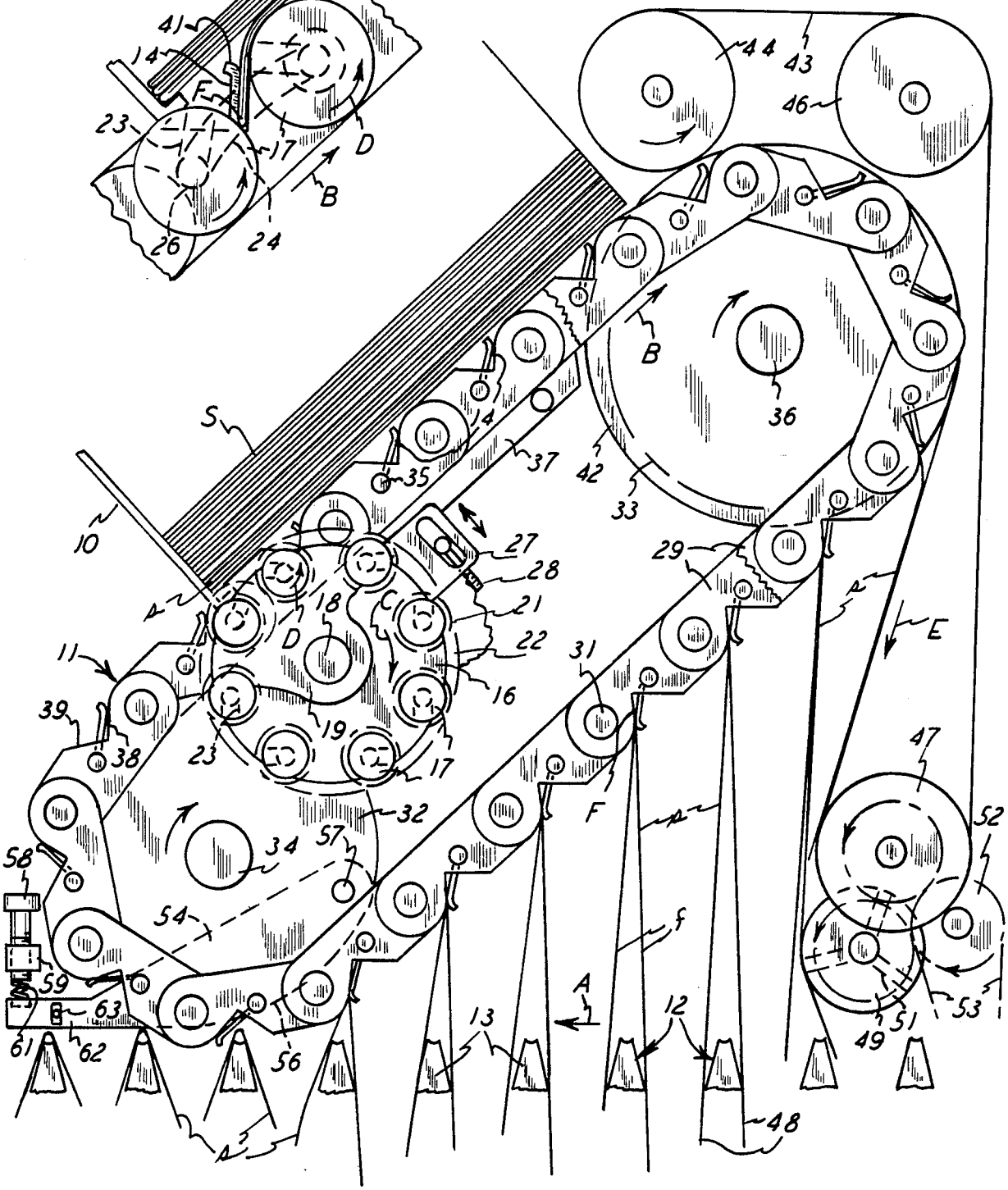
FIG. 1 is a side-elevational view of a preferred embodiment of this invention.

In general, the signatures s are singly removed from the stack S by a pickup device generally designated 11, and the signatures are deposited onto a collector, generally designated 12. The method and apparatus of this invention is that the collector 12 includes the saddle members 13 which move in the direction of the arrow designated A, and that direction is transverse to the line of the folds F in each of the signatures s. Thus, each signature is shown to have two flaps f, each of which is positioned on opposite sides of the saddle member 13, as shown in FIG. 1, and is eventually deposited onto the collector 12 in that saddle position.

Figure 2:
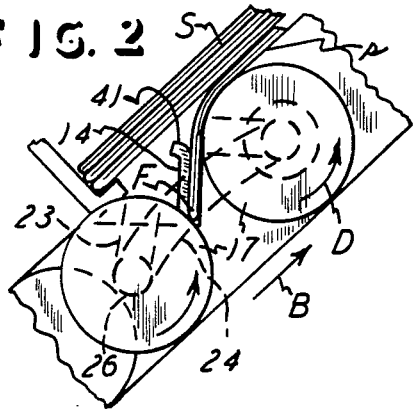
FIG. 2 is a side-elevational view of a fragment of FIG. 1, on an enlarged scale.

In picking up each signature s from the stack S, the pickup device 11 has the plurality of spaced-apart gripper members 14 which hold the signature folds F onto the device 11 and the signatures s are moved along with the movement of the device 11, namely, in the direction of the arrow designated B. To present the signature folds F to each gripper 14, a system or ring of suction rollers generally designated 16 is located adjacent the stack S, and each of a plurality of suction rollers 17 is arranged to act upon the bottom of the lower signature s to pull the fold F thereof down into the control of the respective gripper 14, as shown in FIG. 2. Thus, the roller system 16 rotates in the direction of the arrow designated C and is supported on a spindle 18 which in turn is mounted on a bracket 19. The drawing shows 8 rollers 17 which rotate in the direction of the arrow designated D since each roller 17 has a gear 21 in mesh with a ring gear 22 in the member 16. That is, the ring gear 22 is stationary and the member 16 carries the rotatably mounted roller 17 in a clockwise direction around the ring gear 22 to induce the counter-clockwise rotation D of each roller 17, in a conventional ring gear and planet gear arrangement.

Each roller 17 is a vacuum roller, and it has a vacuum channel 23 extending to the circumference thereof to act upon the bottom one signature s in the stack, as indicated in FIG. 2 with the roller 17 on the right thereof. Thus, the lower signature was pulled, by vacuum acting through the roller 17, down onto the pickup device 11 and into the confines of the gripper 14, as shown in FIG. 2. FIG. 2 also shows that there is a vacuum channel 24 which is in suitable and conventional flow communication with the central vacuum channel 26 in each roller 17 when each roller 17 reaches the position of the roller 17 on the left in FIG. 2. That arcuate channel 24, as shown, then induces vacuum in the radial channel 23 of the roller 17 to apply a suction to the bottom signature s and pull it down into the control of the pickup device 11. To permit suitable and close synchronization of the rollers 17 with the pickup device 11, the support member 16 has a projection 27 which can be adjusted around the center of the shaft 18 to thereby present the vacuum passageways 23 of each roller 17 to the signatures, as desired, and a screw control 28 can be applied to the projection 27 for that type of adjustment mentioned.

The pickup device 11 is shown to be in chain or conveyor form having a plurality of links 29 secured together by pins 31. End sprockets 32 and 33 are rotatably supported on shafts 34 and 36, respectively, for movement of the pickup device 11, as mentioned. A support 37 is shown underneath the chain at the location of the stack S, to provide a planar or straight run of the pickup device 11 past the entire length of the stack S, as shown. Thus, the stack S is also actually supported on the pickup device 11, since the stack is permitted rest downwardly thereon.

The spaced-apart grippers or engagers 14 on the pickup device 11 are spring urged thereon and may be mounted on pins 35. The engagers 14 are suitably spring urged to bear against a respective surface 38 on each link 29, and another link surface 39 forms substantially a right angle with the surface 38, as shown. Thus, the signature s is sucked down onto the surface 38 and underneath the engager 14 which has an upturned tow or end 41 for sliding over the signature s and thus holding it to the device 11. Also, the fold F of the signature can rest against the link surface 39 which is thus pushing the signature to the right, as viewed in the drawings, and thus removing the signature from the bottom of the stack S.

Figure 3:
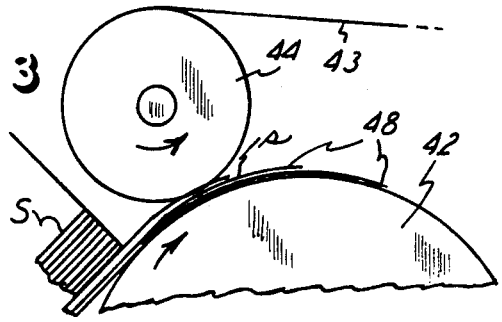
FIG. 3 is a side-elevational view of a fragment of FIG. 1 and showing the signatures in imbricated relationship.

The entire arrangement of roller 17 and grippers or engagers 14 is such that each engager 14 encounters and grips a signature while the chain is moving in the direction of the arrow B, and thus the signatures are placed into an imbricated stream relationship, as indicated in FIG. 3. A large roller or drum 42 has its upper circumference aligned with the lower surface of the stack S to receive the imbricated stream, and, upon rotation of the drum 42 in the clockwise direction, the drum, along with a conventional type of conveyor belt 43, carries and guides the imbricated stream downwardly toward the collector 12. It will be seen and understood that conveyor supports or pulleys 44, 46, and 47, are suitably rotatably mounted to have the belts 43 move in the direction of the arrow designated E for guiding the steam to the collector 12.

Each gripper or engager 14 therefore is carrying one of the signatures s toward the collector 12, and, when the signature reaches the bottom run of the chain 29, the free edges 48 of each folded signature s will be draped downwardly onto the collector 12, as shown. That is, by gravity, the signatures hang down from the chain 29 and are presented to the saddle members 13 of the collector 12. A signature opener 49 is shown engaging the signature s when its free edges 48 first reach the saddle 13, to assure that the opposite flaps of each signature s are positioned on opposite sides of the saddle 13, as shown. Therefore, the opener 49 can have an arrangement of vacuum passageways 51 spaced radially therearound to encounter the near one of the two flaps f of each signature and to draw it away from the far one of the flaps and thus cause the signature to straddle the member 13, as shown.

Also, a rotary drive member 52 is shown engaged with the conveyor pulley 47 for inducing the movement of the belt 43, for instance, and the drive 52 also induces the rotation of the opener 49, in the direction shown. Further, the drive 52 can have a chain or belt 53 extending to the collector 12 for synchronizing the movement of the collector 12 with the movement of the belt 43, and there can also be a like belt drive to the pickup device 11 for synchronizing with the belt 43 and the collector 12, in a conventional arrangement of drive.

Further, in instances where the signature s has its free edges 48 offset from each other or in an uneven fold of signature, then the opener 49 need not even employ suction passageways for causing the flaps f to be disposed on opposite sides of each saddle 13. Instead, simple deflection of the flaps f, as shown in FIG. 1 will be adequate for positioning the signature in straddled position.

It will of course be seen and understood that the spacing of the engagers or grippers 14 is corresponding with the spacing of the saddle members 13, so that the apparatus runs continuously and each saddle member 13 receives a signature. Of course it will be understood that there are a plurality of devices as shown in FIG. 1 and they are in line and side-by-side arrangement, with each device depositing a signature from its particular stack S onto one of the saddles 13 so that a collection of signatures is arranged on each saddle 13, to form the final end product of a book or magazine, in the usual collating. Further, while the collector 12 moves in the direction of the arrow A, the signatures s encounter a shoe 54 which is of course in line with the row of signatures and the row of saddles 13, and the shoe appropriately clears the chain 29 and also its grippers 14, but the signature engages the bottom surface 56 of the shoe and the signature is therefore urged off the gripper 14 and onto the saddle 13. The shoe 54 can be adjustable by means of disposing it on a fixed pivot 57 and having a screw 58 on a mounting 59 to bear downwardly, such as through a spring 61 onto a projecting end 62 of the shoe 57 to have the surface 56 ride on the signatures for the release mentioned. A support or stop 63, of any conventional arrangement, is also engaged with the shoe 54 to guide it, as required for the purpose mentioned.

As disclosed and as seen in the drawing, the signatures drape downwardly, under gravity, when they are extending on the lower run of the chain 29, and the signatures then initially engage the opener 49 and ultimately engage the shoe 54, all to be placed onto the saddles 13 which are moving directly under the signatures and in the direction transverse to the folds F. An arrangement can be that there are two spaced-apart chains 29, with each chain having a gripper 14 aligned with a gripper 14 on the other chain, so that the signature is held at two spaced-apart points adjacent its fold while it is on the pickup device 11. The suction removal member 16 can then be disposed between the two spaced-apart chains 29 for engaging the lower signature in the stack and inducing it to come within the grip and control of the engagers 14. The action and spacing of the suction rollers 17 and the grippers 14 and the saddle members 13 will be such that they will be substantially equal and the collating will be in a continuous movement of the signatures. In the entire process, the signature free edges 48 are moved in a direct path, that is without any reversal of direction, from the stack and onto the saddles 13. Also, the final collating result on the saddles 13 is that the folds are in parallel relationship, rather than in one line as in the prior art, and the signatures are in side-by-side relationship rather than in line. Accordingly, the apparatus is more compact and the speed of the collector 12 can be much lower, for the same production according to the prior art, or the production can be much greater where the speed of collector 12 is greater than that of the prior art collectors. The apparatus and process are such that the amount of offset or imbricating of every two consecutive sheets in the stream is the same as the spacing of the saddle members 13, and, as mentioned, the speeds are also correlated between the suction device 16 and the chains 29 and the collector 12, and also the opener 49, where needed.

Rollers 17 are cylindrical, and extend between the two chains 29 to suck the signatures down onto the surfaces 38. Movement of the chanis 29 in the direction of arrow B causes the signatures to slide underneath the grippers 14 because of the up-turned ends 41. The folds F stop against the surfaces 39, and the chains 29 then push the signatures in the direction of the arrow B, and the ultimate stream formation and movement on the chains 29, and the belt 43, contribute to the movement of the stream of signatures.

What is claimed is:

1. A method of collating signatures, comprising the steps of positioning a stack of folded signatures relative to a moving signature collector, said signatures having flaps extending in a plane in said stack, placing said signatures onto a pickup device in signature-movement communication with said stack and said collector, said pickup device moving completely along said flaps and supporting said stack while removing said signatures, singly removing said signatures from said stack with the free edges of said signatures opposite the folds being in a leading movement position, separately depositing the removed signatures onto said collector in spaced-apart locations along said collector while said collector is moving in a direction transverse to the direction of the folds in said signatures when said signatures are deposited onto said collector.

2. The method of collating signatures as claimed in claim 1, wherein said signatures are gripped at their folds and are pushed along said stack with said free edges in the leading movement position from the time said signatures are deposited onto said collector.

3. The method of collating signatures as claimed in claim 1, wherein said signatures are removed from said stack in an imbricated stream relationship.

4. The method of collating signatures as claimed in claim 1, including moving said collector in a location only underneath the elevation of said stack.

5. The method of collating signatures as claimed in claim 1, wherein said signatures are removed from said stack in an imbricated stream relationship of a uniform distance between the leading edges of every two consective ones of said signatures, and with said distance being less than the dimension of said signatures in the direction of their movement of removal, and depositing said signatures onto said collector in spaced-apart relationships according to said uniform distance.

6. A method of collating signatures, comprising the steps of positioning a stack of folded signatures relative to a moving signature collector, arranging said stack with the signatures thereof in a reclining orientation, moving a pickup device planarly along the reclining plane of the bottom of said stack and pushing the bottom one of said signatures out of said stack by singly removing said signatures from said stack with the free edges of said signatures opposite the folds being in a leading movement position, separately depositing the removed signatures from said pickup device and onto said collector in spaced-apart locations along said collector while said collector is moving in a direction transverse to the direction of the folds in said signatures when said signatures are deposited onto said collector.

7. The method of collating signatures as claimed in claim 6, wherein said signatures are slid off said bottom of said stack in an imbricated stream of signatures.

8. Apparatus for collating signatures from stacks of folded signatures, comprising a stack support for orienting said stack with the signatures thereof in a reclining orientation to present a stack bottom, a movable pickup device for receiving said signatures from said stacks and having a planar portion extending in contact with said stack bottom and with said planar portion being movable in the direction from the fold of said signature to the free edges thereof, signature engagers spaced along said pickup device for receiving said signatures in an imbricated stream with said free edges forward in the stream movement, a collector in signature-transfer communication with said pickup device for receiving signatures therefrom and having signature receiving members spaced therealong in accordance with the spacing of said signature engagers, said collector being movable operable in the direction transverse to the direction of the folds in said signatures, for receiving said signatures on said collector with the folds in side-by-side parallel relationship.

9. Apparatus for collating signatures from stacks of folded signatures, comprising a movable pickup device for receiving said signatures from said stacks, said pickup device being movable in the direction from the folds toward the free edges of said signatures and has signature engagers spaced therealong for arranging said signatures in an imbricated stream relationship, for pushing said signatures off said stacks and onto said collector with the free edges first, a collector in signature-transfer communication with said pickup device for receiving signatures therefrom, said collector being movably operable in the direction transverse to the direction of the folds in said signatures, for receiving said signatures on said collector with the folds in side-by-side parallel relationship.

10. The apparatus for collating signatures from stacks of folded signatures as claimed in claim 9, wherein said pickup device is a conveyor having a planar portion extending past said stack and parallel thereto and extending in a plane completely from said folds to the free edges of said signatures.

11. The apparatus for collating signatures from stacks of folded signatures as claimed in claim 10, wherein said collector has signature receiving members spaced therealong in the spacing corresponding to the spacing of said engagers on said pickup device.

12. The apparatus for collating signatures from stacks of folded signatures as claimed in claim 9, including spaced-apart signature engagers on both said pickup device and said collector and with the spacing between all said engagers being equal.

13. The apparatus for collating signatures from stacks of folded signatures as claimed in claim 9, including means for opening the folds of said signatures for depositing said signatures onto said collector.

14. The apparatus for collating signatures from stacks of folded signatures as claimed in claim 9, including means for vacuum moving said signatures from said stacks and onto said pickup device.

15. The apparatus for collating signatures from stacks of folded signatures as claimed in claim 9, including means for removing said signatures from said pickup device for depositing said signatures onto said collector.

16. The apparatus for collating signatures from stacks of folded signatures as claimed in claim 9, wherein said pickup device is movable in the direction from the folds toward the free edges of said signatures and includes a planar extending portion extending parallel to and throughout the extent of the dimension of said signatures from said folds to said free edges, for depositing said signatures onto said collector with the free edges first, said pickup device has signature engagers spaced therealong for arranging said signatures in an imbricated stream relationship.

* * * * *